United States Patent [19]

Lin

[11] 4,426,175

[45] Jan. 17, 1984

[54] METHOD OF AND APPARATUS FOR REINFORCING PILING STRUCTURE AND IMPROVED PRECAST CONCRETE PILE SUITABLE FOR USE IN SAID METHOD

[76] Inventor: Juei-Tse Lin, No. 37-3, Szu Chuan Rd., Sec. 2, Pan Chiao City, Taipei Hsien, Taiwan

[21] Appl. No.: 333,688

[22] Filed: Dec. 23, 1981

[30] Foreign Application Priority Data

Jul. 3, 1981 [JP] Japan ..... 56-104795

[51] Int. Cl.[3] ..... E02D 5/44

[52] U.S. Cl. ..... 405/237; 405/240; 405/247; 405/248; 405/269

[58] Field of Search ..... 166/285, 155, 317; 405/237, 247, 240, 233, 269, 248, 246, 242, 241, 236; 138/89, 90

[56] References Cited

U.S. PATENT DOCUMENTS

| | | | |
|---|---|---|---|
| 2,591,807 | 8/1947 | Greene | 405/237 |
| 3,010,514 | 11/1961 | Fox | 166/285 |
| 3,184,924 | 11/1961 | Staunau | 405/237 |
| 3,578,083 | 5/1971 | Anderson et al. | 166/285 |
| 4,045,966 | 9/1977 | Rusche | 405/240 |
| 4,299,255 | 11/1981 | Miller | 138/89 |

*Primary Examiner*—Dennis L. Taylor
*Assistant Examiner*—John A. Gungor
*Attorney, Agent, or Firm*—Burns, Doane, Swecker and Mathis

[57] ABSTRACT

A precast concrete pile is provided which has spaced apart concavities disposed in its inner or outer peripheral wall surface. The spaced apart concavities partially extend into the wall surface and terminate with frangible end portions. These end portions break under pressure of mortar pumped into the pile body, thereby forming apertures through which the mortar flows from the pile into the ground adjacent the pile. The precast concrete pile, after being driven into the ground, has a hydraulic sealing apparatus suspended at a desired level within the pile. The hydraulic sealing apparatus is filled with oil to cause radial swelling of the rubber packing to seal off a hollow space within the pile under the packing, and mortar is pumped under pressure into the sealed space until the concavities burst open to enable internal mortar to penetrate the ground surrounding the pile. The subsequently hardened masses of mortar serve as a set of claws protruding outwardly from within the pile body to prevent settlement thereof.

7 Claims, 6 Drawing Figures

METHOD OF AND APPARATUS FOR REINFORCING PILING STRUCTURE AND IMPROVED PRECAST CONCRETE PILE SUITABLE FOR USE IN SAID METHOD

The present invention relates to piling installation, and particularly to a method and apparatus for reinforcing piling structure to prevent substructures, and hence buildings supported thereon, from settling. This invention also relates to an improved precast concrete pile particularly suitable for use in the method.

In the construction industry a commonly used method of pile driving for foundation construction is to drive hollow, concrete piles having a conic, closed end into the ground by means of a pile driver. However, since the concrete pile of this type generally has a smooth outer surface, friction between the pile and the surrounding soil is lessened. Therefore, unless driven substantially into hard solid strata such as a bed of firm rock, the pile tends to settle, while the accompanying settlement of the foundation supported on these piles can have damaging effects on the building or structure resting thereon, e.g., at best, cracks in the walls, and at worst, the collapse of the building in case of earthquake shocks. This usually happens to buildings constructed on a beach, where the soil is loose and unstable.

Thus the present invention is aimed to substantially overcome or ameliorate the above disadvantages.

According to one aspect of the present invention, there is provided a method of reinforcing piling structure to overcome the above-mentioned disadvantages in conventional methods of installing piles.

According to another aspect of the present invention, there is provided an improved precast concrete pile which is formed with a plurality of spaced-apart concavities disposed in its peripheral wall, the concavities being fragile and breakable under pressure.

According to still another aspect of the present invention, there is provided an apparatus which comprises a hydraulic cylinder in which is closely fitted a piston attached to a Piston rod, a pair of spaced, coaxially aligned discs for cooperation with the piston rod, and a resilient rubber packing which is deformable when compressed between the discs.

The invention will now be described in detail hereinafter with reference to the accompanying drawings which illustrate preferred embodiments of the invention.

Figure 1:
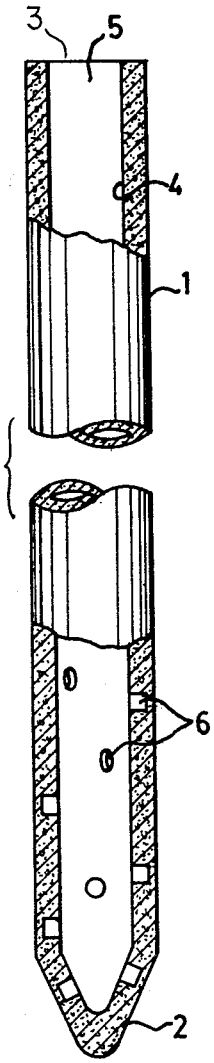
FIG. 1 is a perspective view, partly broken away, of an embodiment of a concrete pile in accordance with the invention.

Referring first to FIG. 1, there is depicted a hollow, precast concrete pile 1 of the invention which comprises an elongated, cylindrical body having at one end a conical closed tip 2 and in the other end an opening 3. The inner peripheral wall 4 surrounding a hollow space

Figure 2A:
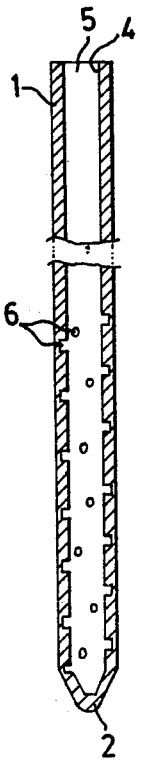
FIGS. 2A and 2B are sectional views, partly broken away, of another two embodiments of the concrete pile.
Figure 2B:
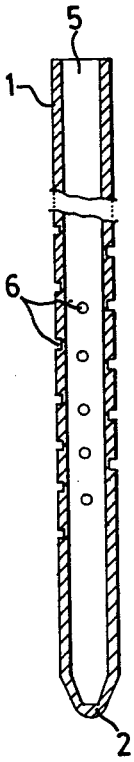

5 of the pile body 1 is formed with thin and frangible portions in the form of a plurality of spaced-apart concavities 6 disposed in an upwardly spiralling order. It is seen from FIG. 1 that the concavities 6 are disposed almost along the length of the pile 1 from the lower conical end 2 up to nearly the opening 3. However, the concavities may also be disposed along a given section of the pile, e.g., along the lower section as shown in FIG. 2A or along the middle section in FIG. 2B. Alternatively, the concavities may be disposed in the outer peripheral wall of the pile as seen from FIG. 2B. Also it is to be understood that although the thin and frangible portions are formed of round holes, they may be of any shape.

Figure 3:
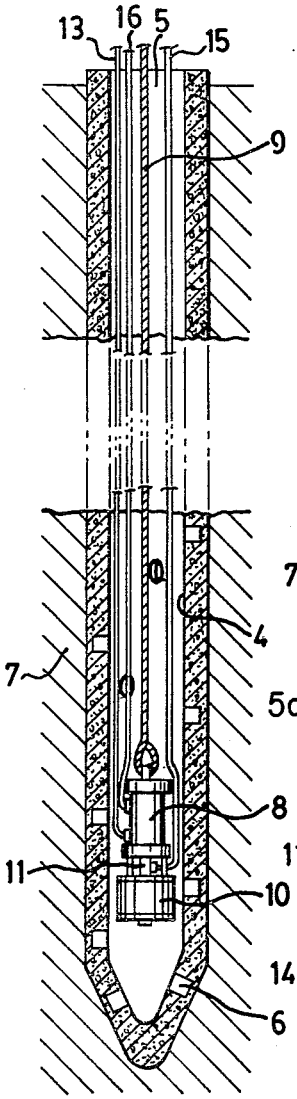
FIG. 3 is a schematic presentation of one form of the method of the invention, in which mortar is to be pumped into the pile body.
Figure 4:
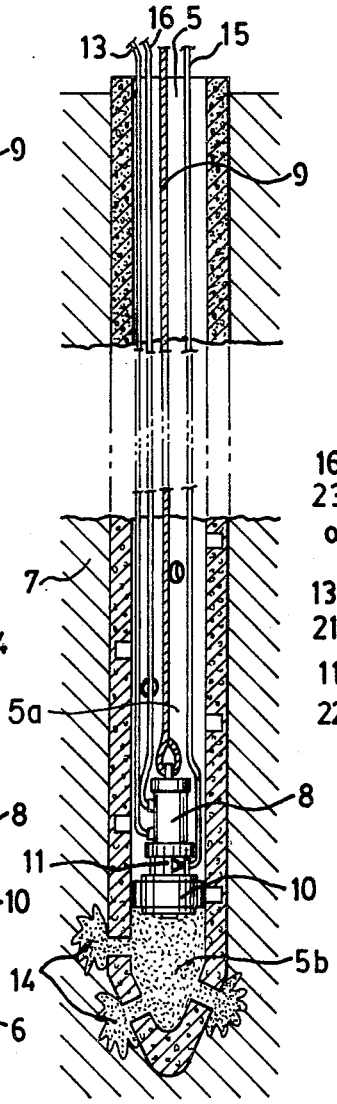
FIG. 4 is a schematic presentation of another form of the method of the invention, in which the injection of mortar is completed.

Referring now to FIGS. 3 and 4, there is depicted the precast concrete pile 1 driven into the ground 7 by means of a pile driver in a known manner. Held in suspension at a desired level within the hollow space 5 of the pile by a cable 9 is a hydraulic cylinder 8 fitted thereunder with a rubber packing 10 which is deformable in response to reciprocating motion of a piston rod 11. By pumping oil through an oil hose 13 into the lower part of the hydraulic cylinder 8, a piston 12 which is attached to the piston rod 11 and closely fitted in the hydraulic cylinder is driven up to cause upward movement of the piston rod 11. On its upward journey the piston rod 11 in turn causes the rubber packing 10 to swell radially and finally fill up the clearance between the rubber packing and the inner wall surface of the pile so that the hollow space 5 of the pile is divided into two sections **5*a* and 5*b*, with the section 5*b* being a sealed hollow space (see FIG. 4). Then cut off the oil supply to the hydraulic cylinder 8 and pump mortar through a hose 15 into the sealed hollow space 5*b*. When the sealed hollow space 5*b* is bursting with pressurized mortar, the injection of more mortar will cause the fragile concavities 6 to break from increasing internal pressure, thus enabling the internal mortar M to rush out through the apertures into the surrounding soil 7. The outflowing mortar then hardens to form a plurality of masses of mortar 14, or a first set of claws, extending radially outwardly from within the body of the pile. Thereafter, cut off the mortar supply and inject oil through another hose 16 into the upper part of the hydraulic cylinder 8 to force the piston 12, and hence the piston rod 11, to move downward, while the rubber packing 10** is caused to return to its original condition upon removal of the pressure exerted thereon. The hydraulic cylinder is then lifted to reach a desired height in preparation for the formation of a second set of claws. The same operation as above proceeds by stages until the required number of sets of claws is obtained.

Figure 5:
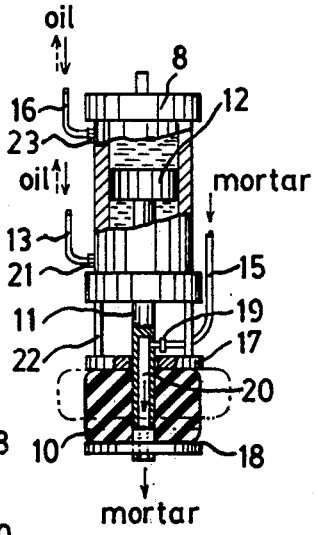
FIG. 5 illustrates in elevation and partly in section a hydraulic sealing apparatus for carrying out the method of the invention.

Referring now to FIG. 5, there is provided a preferred embodiment of the hydraulic sealing apparatus for carrying out the method of the invention. As described hereinbefore, the hydraulic cylincer 8 incorporates the piston 12 which is capable of transmitting reciprocating motion to the piston rod 11 when oil is injected into the cylinder 8. The piston rod 11 extends through the bottom end of the cylinder 8 into the center of a fixed disc 17 which is connected to the bottom end of the cylinder 8 by a plurality of connecting rods 22. A movable disc 18 fixed to the free end of the piston rod is spaced from and coaxially aligned with the fixed disc 17. Interposed between the discs 17 and 18 is the annular rubber packing 10. When the piston 12 is moved upward, the rubber packing 10 will be pressed against the fixed disc 17 by the axial stress of the movable disc 18 such that the rubber packing contracts axially and swells radially simultaneously to abut against the inner wall surface of the pile 1, the position of the deformed rubber packing being shown by the phantom line in FIG. 5. In order that mortar may pass into the sealed hollow space 5*b*, a channel 20 extending from above the disc 17 and terminating in the free end of the piston rod 11 is formed within the piston rod while the hose 15 and the piston rod are connected by a joint 19 adjacent the top surface of the disc 17 so that the hose 15 communicates with the channel 20. A pair of joints 23 and 21 mounted on the upper and lower peripheral wall of the hydraulic cylinder 8, respectively, are provided for connection of a pair of oil hoses 16 and 13 to the hydraulic cylinder. By the pressure of oil injected through the hose 13 into the lower part of the hydraulic cylinder, the piston 12 is driven upward to thereby cause corresponding movement of the piston rod 11, whereas downward movement of the piston 12 and piston rod 11 is effected by injecting oil through the hose 16 into the upper part of the hydraulic cylinder. Since the movable disc 18 moves in the same direction as the piston rod 11 moves, the deformation and restoration of the rubber packing 10 is controlled by displacement of the disc 18.

In order that the hydraulic sealing apparatus may operate within the hollow body of the pile, the hollow body should be greater in diameter than the hydraulic cylinder, both discs and the rubber packing; also there should be space available for accommodating the hoses 13, 16 and 15. The rubber packing should be of such a thickness and diameter as to enable itself, when compressed between the discs after the piston rod has moved a preset distance, to radially swell and eventually close the clearance between itself and the surrounding inner surface of the pile. Moreover, the position of the joint 19 which connects the hose 15 and the piston rod 11 must remain below the bottom end of the hydraulic cylinder after the piston rod has moved upward the preset distance.

Since hardened masses of mortar serve not only to prevent piles driven into the ground from settling but to solidify the foundation at a construction site, the present invention is of great significance to the safety of residents and yet a breakthrough in conventional methods of piling installation.

I claim:

1. A precast concrete pile which comprises a hollow cylindrical body of precast concrete with a closed end and adapted to reinforce and solidify a foundation and prevent settling of structures thereon when driven into ground by means of a pile driver, further characterized by being formed with frangible portions in the form of a plurality of spaced-apart concavities disposed in its inner peripheral wall surface, the spaced apart concavities partially extending into the wall surface and terminating with frangible portions and being adapted to allow breakage of the frangible portions under the pressure of mortar pumped into the pile body, thereby to form apertures through which mortar may flow from the pile into the ground adjacent the pile.

2. A precast concrete pile according to claim 1, wherein the spaced apart concavities are disposed in the inner peripheral wall surface in an upwardly spiralling order, and wherein the closed end of the pile is conic in shape.

3. A precast concrete pile which comprises a hollow cylindrical body of precast concrete with a closed end and adapted to reinforce and solidify a foundation and prevent settling of structures thereon when driven into ground by means of a pile driver, further characterized by being formed with frangible portions in the form of a plurality of spaced-apart concavities disposed in its outer peripheral wall surface, the spaced apart concavities partially extending into the wall surface and terminating with frangible portions and being adapted to allow breakage of the frangible portions under pressure of mortar pumped into the pile body, thereby to form apertures through which mortar may flow from the pile into the ground adjacent the pile.

4. A precast concrete pile according to claim 3, wherein the spaced apart concavities are disposed in the outer peripheral wall surface in an upwardly spiralling order, and wherein the closed end of the pile is conic in shape.

5. A hydraulic sealing apparatus, characterised by comprising a hydraulic cylinder in which is fitted a piston, a piston rod attached at one end to the piston and having a channel in its lower section, a fixed disc connected to a bottom end of the hydraulic cylinder through a plurality of connecting rods, a corresponding movable disc spaced from the fixed disc and fixed to a free end of the piston rod for concerted movement therewith, a supply line connected to the channel in the piston rod to allow passage of mortar into the hollow space of a precast concrete pile in which the apparatus is in use inserted, oil supply line means connected to the hydraulic cylinder for introducing oil into same to cause vertical movement of the piston, and a resilient rubber packing interposed between the fixed and movable discs so that when upward movement of the piston causes corresponding movement of the movable disc against the rubber packing, the rubber packing is compressed to swell radially to seal against a surrounding inner surface of the pile above said hollow space.

6. A method of reinforcing a piling structure, characterised by comprising driving into ground a precast concrete pile having a hollow body and a plurality of concavities spaced along its length, holding in suspension at a desired level within the hollow body of said pile a hydraulic cylinder fitted with a resilient rubber packing thereunder, filling the hydraulic cylinder with oil to cause radial swelling of the rubber packing to such an extent that the radially swelled rubber closes between itself and a surrounding inner periphery of the pile body and thus defines therwith a sealed hollow space under the rubber packing, pumping mortar under pressure through a mortar supply line into the sealed space of the pile until said concavities burst open from increasing internal pressure thus enabling the internal mortar to penetrate the ground surrounding the pile, with subsequently hardened masses of mortar serving as a set of claws protruding outwardly from within the pile body to prevent settlement thereof, cutting off the mortar supply and injecting oil into the hydraulic cylinder to cause the rubber packing to return to its original condition.

7. A method of reinforcing a piling structure according to claim 6, further comprising lifting said hydraulic sealing apparatus to a second desired height in preparation for formation for a second set of claws, and repeating the same operation of above steps by stages until a desired number of sets of claws is obtained.

* * * * *